US006388163B1

(12) United States Patent
Tadros

(10) Patent No.: US 6,388,163 B1
(45) Date of Patent: May 14, 2002

(54) METHOD FOR CHEMICALLY INACTIVATING ENERGETIC MATERIALS AND FORMING A NONDETONABLE PRODUCT THEREFROM

(75) Inventor: Maher E. Tadros, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/345,602

(22) Filed: Jun. 29, 1999

(51) Int. Cl.[7] ..... A62D 3/00

(52) U.S. Cl. ..... 588/202; 149/124; 252/182.26; 523/428; 528/93; 528/121; 528/123; 588/218; 588/255

(58) Field of Search ..... 528/93, 121, 123; 523/428, 180; 252/182.26; 588/218, 255, 202; 149/124, 19.6

(56) References Cited

U.S. PATENT DOCUMENTS 3,184,352 A * 5/1965 Baker ..... 149/19.6
3,499,289 A * 3/1970 Olsen ..... 149/19.6 X
4,234,632 A * 11/1980 Lubowitz ..... 588/255 X
4,348,505 A * 9/1982 Di Benedetto et al. . 252/182.26 X
4,599,196 A * 7/1986 De Tassigny ..... 588/218 X
4,923,910 A * 5/1990 Kitagawa et al. ..... 523/428
5,221,726 A * 6/1993 Dabi et al. ..... 528/93
5,530,175 A * 6/1996 Johnson et al. ..... 149/124 X

* cited by examiner

*Primary Examiner*—Richard D. Lovering
(74) *Attorney, Agent, or Firm*—Russell D. Elliott

(57) ABSTRACT

A method for rendering nondetonble energetic materials, such as are contained in or removed from decommissioned ordnance. The energetic materials are either combined with epoxy hardener or are combined with other compounds, preferably amine compounds, to form a substance that functions as an epoxy hardener. According to the invention, energetic materials (including TNT, RDX and Composition B) that are treated according to the invention method yield a reaction product that is non-explosive, that serves to harden or cure conventional epoxy resin to form a stable, nonexplosive waste product. Epoxy hardener made using the method of the invention is also described.

15 Claims, 5 Drawing Sheets

METHOD FOR CHEMICALLY INACTIVATING ENERGETIC MATERIALS AND FORMING A NONDETONABLE PRODUCT THEREFROM

This invention was made with Government support under Contract DE-AC04-94AL85000 awarded by the U.S. Department of Energy. The Government has certain rights in the invention.

BACKGROUND OF THE INVENTION

1. Field of the Invention (Technical Field)

This invention relates generally to the field of energetic materials management, and specifically destruction and disposal of decommissioned explosive devices and the energetic materials associated with such explosive devices.

2. Background Art

The United States Government, as well as other governmental entities and, in some instances, commercial concerns, face the challenge of disposing of undetonated explosive materials when the devices with which those materials are associated reach the end of their useful lives. Destruction of energetic materials is necessary, for example, in connection with demilitarization of bulk energetic materials and assembled munitions when those materials or munitions become obsolete or are determined to be excess or off-specification. It is estimated that current U.S. Department of Defense stockpile of energetic materials that needs to be destroyed is in the hundreds of thousands of tons, and it increases by approximately 60,000 tons per year. Other government agencies, including the U.S. Department of Energy, have significant amounts of weapons components that, likewise, need to be destroyed as part of stockpile maintenance.

Typically, such energetic materials are disposed of through what are called open burn/open detonation (OB/OD) operations. These operations involve, as the name suggests, detonating or simply burning energetic materials that have endured beyond their useful life, but that still retain explosive properties. A number of environmental and legal issues face those employing this method of disposal, however, including concerns associated with noise and shock pollution, metal spatter, and lead emissions.

A need remains for an economically and environmentally sound chemical process that will safely render explosives materials, such as RDX and TNT, non-explosive and yield a conveniently disposed waste product without generating significant amounts of toxic or environmentally harmful byproducts.

SUMMARY OF THE INVENTION

The present invention provides a method for chemically treating energetic materials and using the product of the treatment reaction as curing agent for polymer resin, thereby yielding a nonexplosive, stable product. This product may be conveniently disposed of according to procedures commonly used for disposal of polymeric materials as solid waste, or it could be used as a structural material for a number of applications such as adhesives. In the preferred embodiment of the present invention, energetic materials such as TNT (trinitrotoluene), RDX (cyclonite) and Composition B (a composition containing 40 percent TNT, 59 percent RDX, and 1 percent wax) are treated by reacting them with an organic amine at low temperatures. The reaction products then serve as curing agents for conventional epoxy resins to yield polymers that exhibit mechanical and thermal properties similar to conventional epoxy polymers. Commonly employed modes of analysis of energetic materials demonstrate that the explosives treated in the fashion described herein are no longer capable of being detonated.

Accordingly, it is an object of the present invention to provide an alternative to OB/OD operations for disposing of demilitarized energetic materials.

It is another object of the present invention to provide a method for depriving energetic materials of their explosive characteristics without creating significantly harmful environmental toxins in the process.

It is yet another object to provide a method for inactivating explosive materials which yields a stable waste product that may be conveniently disposed of using commonly used disposal modalities such as burial.

An advantage of the present invention is that various amine compounds, including commercially available amine-based epoxy curing agents, may be mixed with energetic materials and then combined with traditional epoxy resins to form the stable waste product.

Another advantage of the present invention is that it provides a method for rendering energetic materials non-explosive, the method comprising mixing the energetic material with a reagent comprising an amine to form a reaction product that is non-explosive.

Yet another advantage of the invention is that it provides a method for rendering energetic materials non-explosive, comprising mixing the energetic material with a reagent comprising an epoxy curing agent to form a reaction product that is non-explosive.

Yet another advantage of the invention is that it provides a new epoxy curing agent prepared by combining energetic material with a reagent selected from either conventional epoxy curing agents (for example commercial epoxy hardeners) and compounds comprising amines These and other objects and advantages are satisfied by the method of the present invention wherein energetic materials are treated with amines to yield reaction products which, when combined with epoxy resin, cure the resin to form a stable, non-explosive epoxy resin product that can be conveniently disposed of using conventional disposal methods.

Other advantages and novel features will become apparent to those skilled in the art upon examination of the following description or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
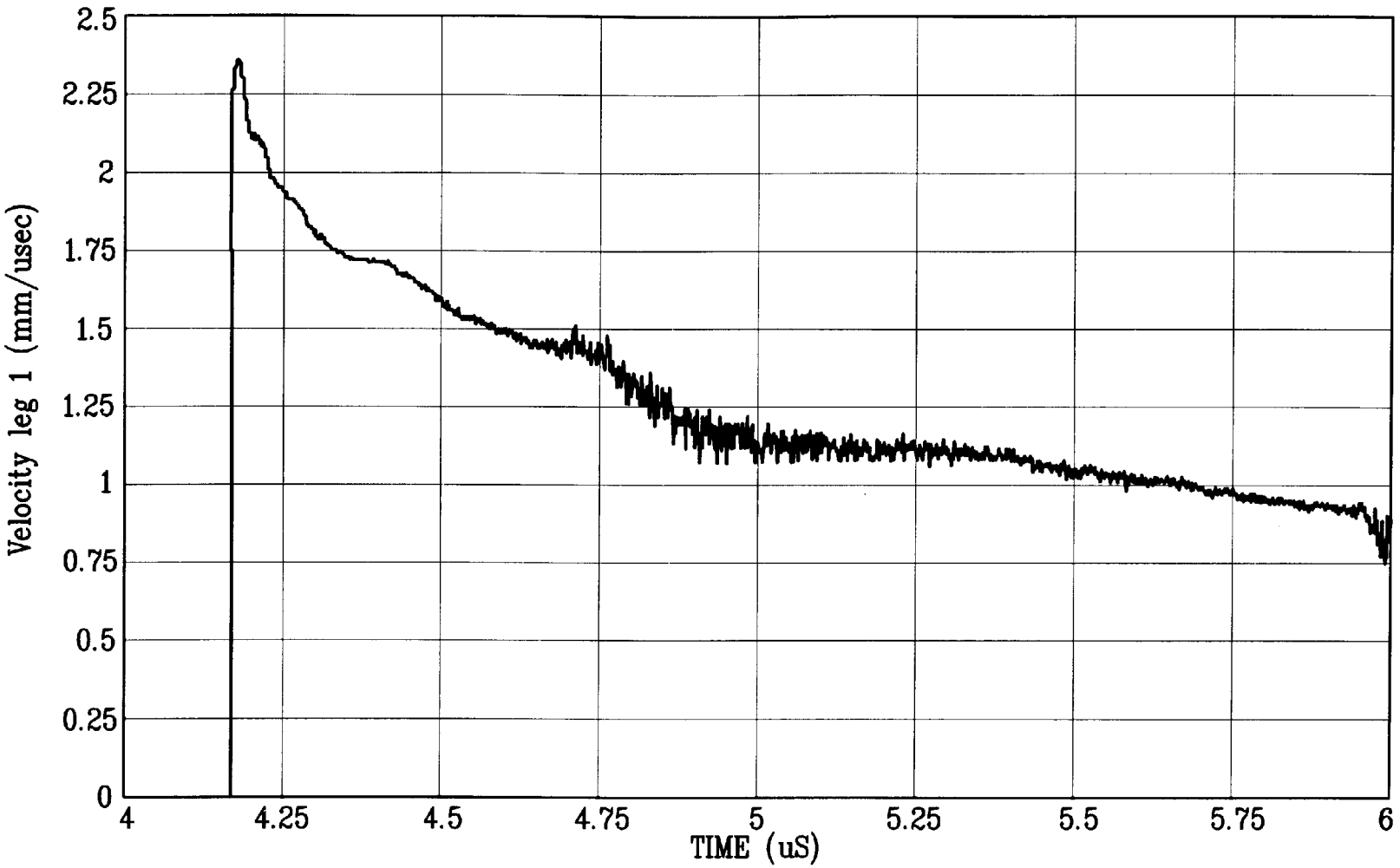
FIG. 1 is a graph showing shock data for RDX.

Organic amines react with high explosive materials such as TNT, RDX explosive D and Composition B. These reactions take place at low temperature (e.g. within the range of 25–150° C.) and lead to safe breakdown of the explosive material without detonation. The reaction products of this reaction are then used to cure conventional epoxy resins to form polymers similar to conventional epoxy polymers.

Suitable organic amines for this process include primary amines ($RNH_2$), secondary amines (RR'NH) and tertiary amines (RR'R"N). In one preferred embodiment, diethylenetriamine is used to break down the explosive material and form a suitable epoxy hardener. Other suitable forms of amines for use in the invention method include diethylenetriamine, tributylamine and monoethanolamine. Successful results have likewise been demonstrated, though, as well, by combining energetic materials with a standard epoxy curing agent. The epoxy polymer resulting from combination of the reaction products with epoxy resin has been analyzed using differential thermal analysis (DSC), thermogravimetric analysis (TGA) and adiabatic calorimetry. As the data discussed below demonstrate, the resulting polymers have been shown to be non-explosive. No solvents are released as a result of the method of the invention, and gases evolved during reactions of RDX and TNT with amines were found to be ammonia and dinitrogen oxide. No release other materials toxic to the environment has been detected.

The following examples demonstrate preferred embodiments of the invention. They are intended to be illustrative, but not limitative of the scope of the appended claims.

EXAMPLE 1

Commercial epoxy resin and curing agent were used to test the ability of the curing agent to deactivate RDX and the applicability of the reaction products as curing agents for the epoxy resin. In this example, researchers used epoxy resin EPON™ 828 from Shell Corporation and the curing agent Jeffamine® T-403 from Huntsman™. (Jeffamine® T-series products are propylene oxide-based triamines prepared by reaction of PO with a triol initiator, followed by amination of the terminal hydroxyl groups.)

RDX and curing agent were reacted by slowly adding 2 g RDX to 10 g Jeffamine® curing agent while the temperature was maintained at 110° C. Gases were observed to evolve during the addition of the RDX. The solution turned from colorless to yellow and the viscosity increased. Upon cooling to room temperature, epoxy polymer was made as follows: 10 g of EPON™ epoxy resin was mixed with 4 g of the yellow product just mentioned. This mixture was then cured at 57° C. for 10 hours, resulting in an epoxy polymer having similar physical characteristics to those of ordinary epoxy polymer.

Various analyses were performed on the polymer resulting from the steps just described, and they are summarized here. The glass transition temperature of the epoxy formed was determined and compared with a control sample of epoxy polymer formed following the same method but without first reacting the curing agent with RDX. The glass transition temperature for the control epoxy sample was 68.6° C., and the corresponding value for the product obtained using the RDX/curing agent byproduct was 72.0° C.

The epoxy polymer prepared from the RDX/curing agent byproduct was subjected to burn and detonation testing to determine whether it posed a potential hazard. The results were compared with RDX samples and with control epoxy samples made according to the same process, except that RDX was omitted. The burn test procedure followed the standard Transportation of Dangerous Goods method found in the second edition of "Small Scale Burning Test, United Nations, New York, 1990, Section 29, p. 114. None of the epoxy samples made with RDX/curing agent byproducts exploded or detonated.

Figure 2:
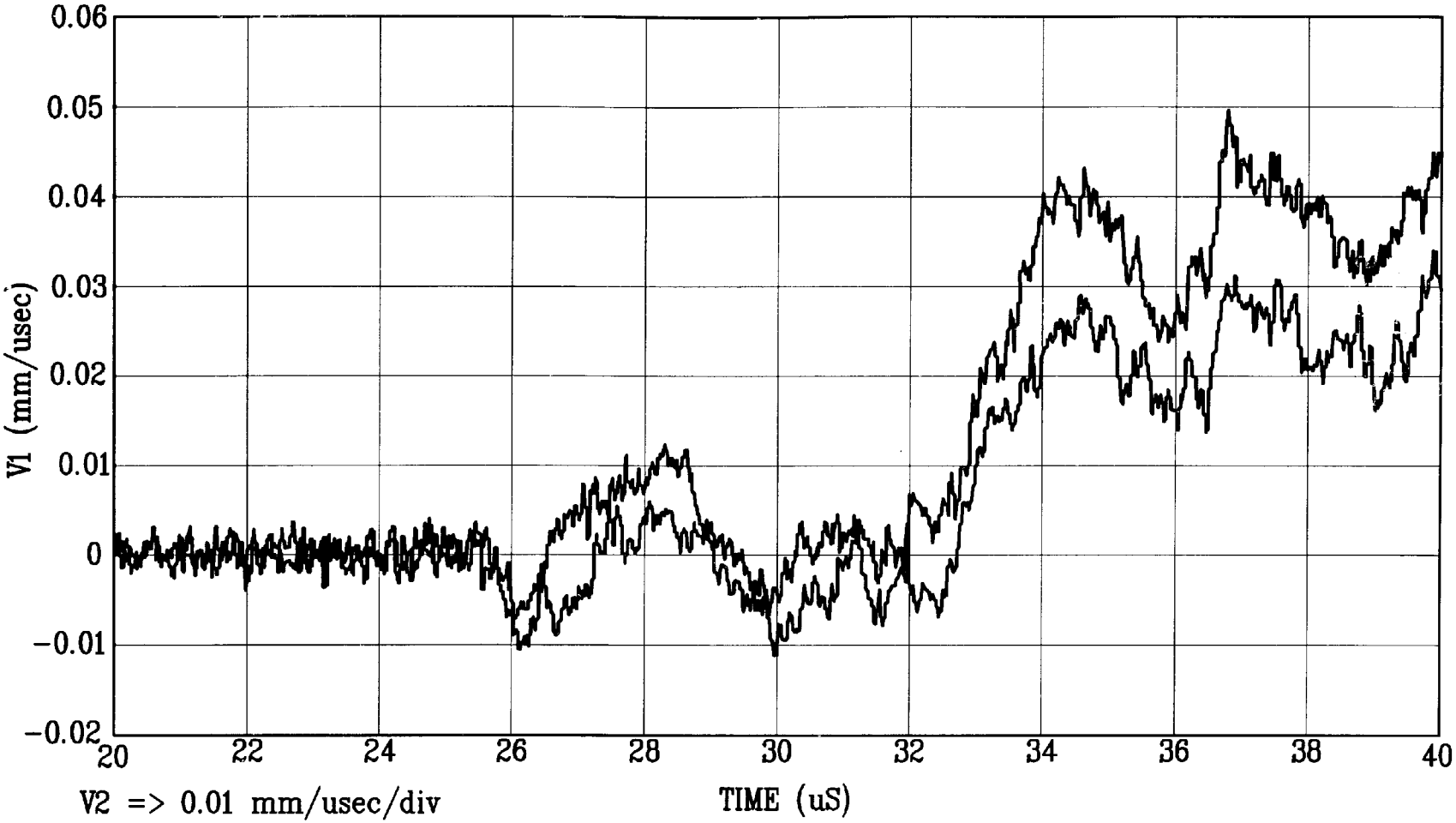
FIG. 2 is a graph showing shock data for epoxy made using RDX combined with a commercial curing agent.

The detonation potential of the samples was also determined using a Velocity Interferometer System for Any Surface (VISAR) method. VISAR measures particle velocities of shock loaded materials using a modified Michelson interferometer to generate Doppler-shift information. Using a data reduction program, the signal generated is converted to velocity versus time plots. FIG. 1 illustrates such a plot for untreated RDX. The propagation speed for RDX alone is typically in the range of 2900 m/sec and a distinguishing feature of the plot is the rapid peak (apparent in the Figure) at the beginning of the time period. FIG. 2 shows propagation speed data for both the control epoxy sample and the epoxy made using the RDX/curing agent. Neither exhibited detonation behavior associated with a rapid peak at the beginning of the plot.

Figure 3:
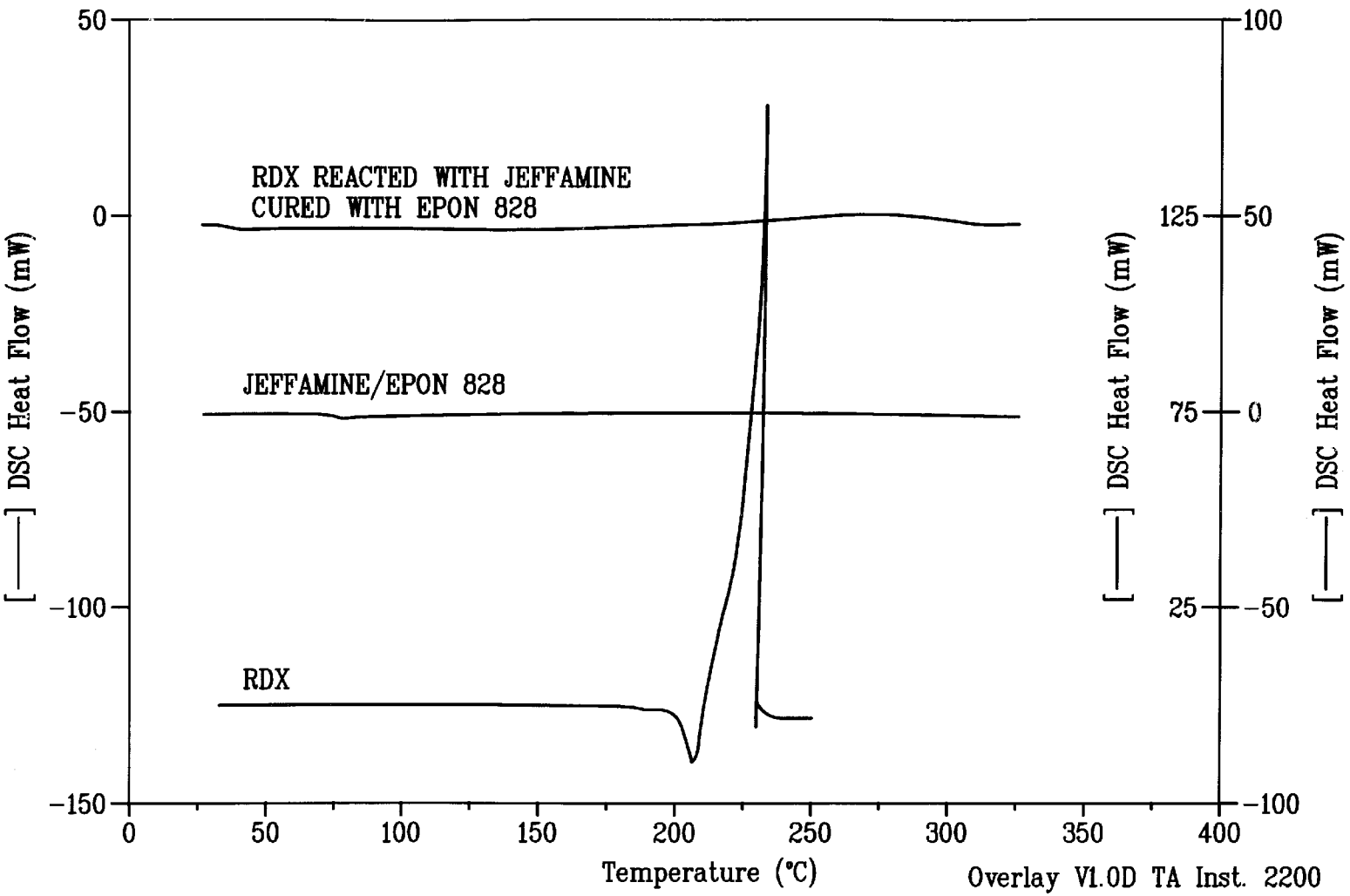
FIG. 3 is a graph showing differential thermal analysis results comparing results for RDX, ordinary epoxy, and epoxy made using RDX combined with a commercial curing agent.

In addition, differential thermal analysis experiments were carried out on the epoxy made using RDX/curing agent. FIG. 3 shows these data compared with similar results for control epoxy and for RDX. The RDX data shows a large trough in DSC heat flow followed by a very large peak, typical of an explosive material. Neither the control epoxy nor the epoxy made using RDX/curing agent exhibit any behavior suggestive of explosive characteristics. These results confirm the absence of an explosion hazard associated with either of the epoxy samples.

EXAMPLE 2

The same experiment as in Example 1 was performed, except using TNT instead of RDX. In this instance, the solution turned dark red/brown in color instead of yellow. An epoxy polymer was formed using TNT/cunning agent in a fashion similar to that used previously to form the polymer with RDX/curing agent.

For the epoxy made using TNT/curing agent, the glass transition temperature was 54.5° C. (again with the control epoxy sample showing a glass transition temperature of 68.6° C.). As was the case with the RDX epoxy polymer, the TNT epoxy polymer did not detonate or explode upon burning or shocking.

EXAMPLE 3

Figure 4:
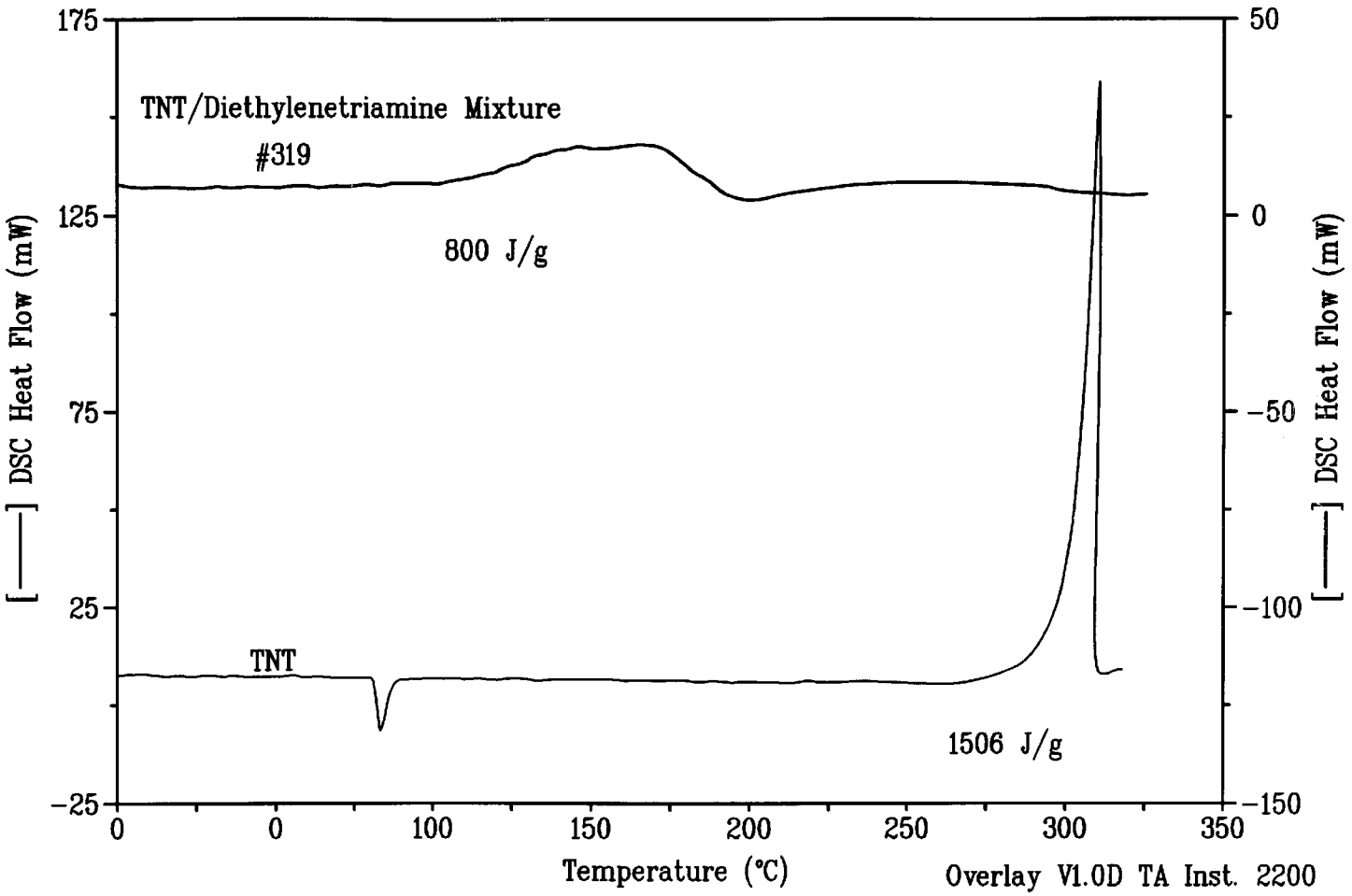
FIG. 4 is a graph showing differential thermal analysis results comparing results for TNT and epoxy made using TNT combined with a commercial curing agent.
Figure 5:
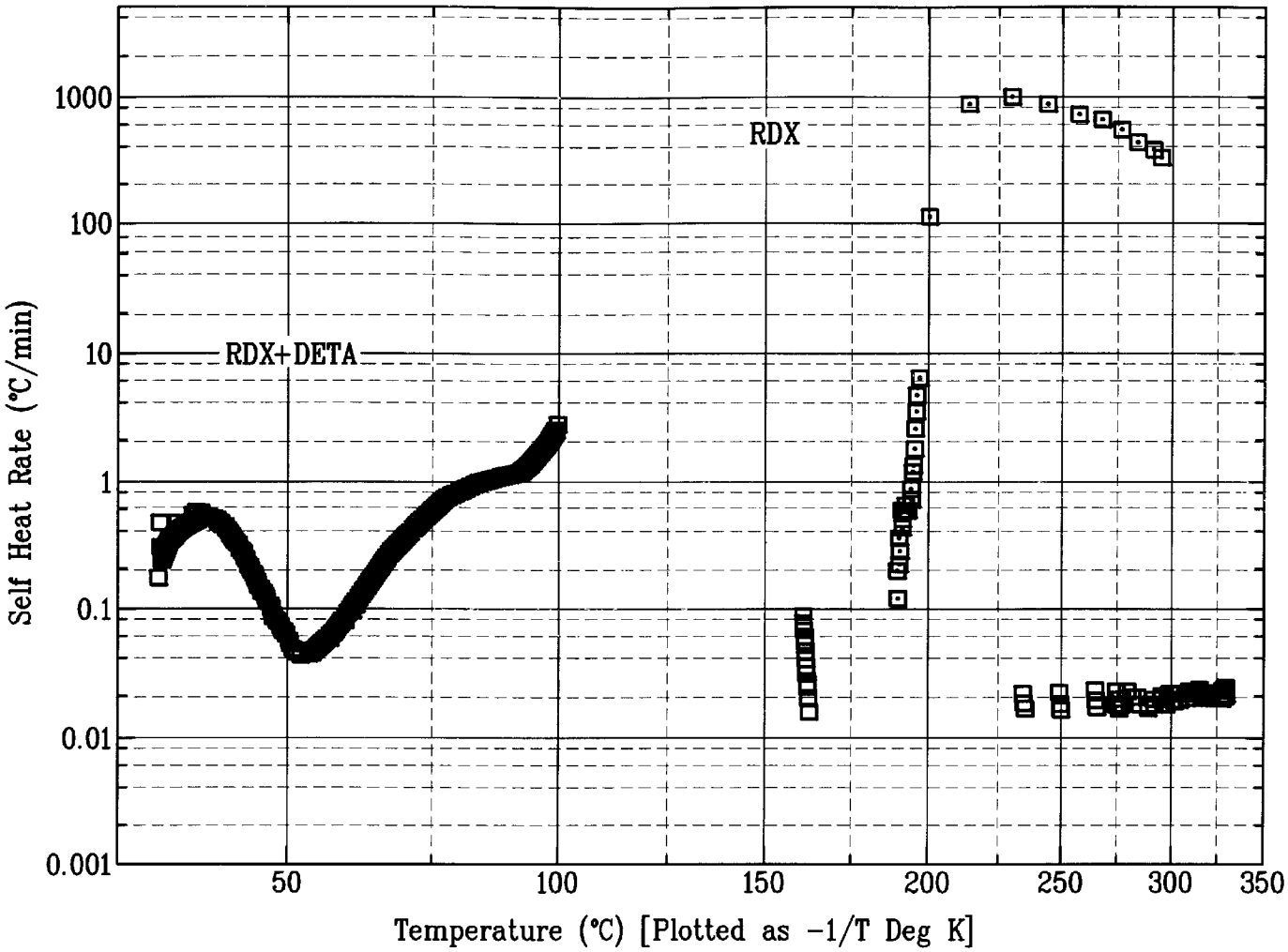
FIG. 5 is a graph showing adiabiatic calorimetry results for RDX and for RDX mixed with diethylenetriamine.

Differential thermal analysis was performed on a mixture of one part TNT and one part diethylene triamine. This mixture was prepared at liquid nitrogen temperature and then transferred to the differential thermal analysis equipment. Data from that analysis are shown in FIG. 4 together with data from ordinary TNT. The TNT data shows a typical explosive peak in heat flow, in this instance, near 300° C. No similar sharp exothermic peak is apparent for the TNT/diethylenetriamine mixture.

EXAMPLE 4

Adiabatic calorimetry experiments were carried out for the mixtures of RDX and diethylenetriamine (prepared using 1:1 concentrations in a fashion similar to the mixture mentioned in Example 3, above). The results are depicted in FIG.

5 and compared to results obtained with RDX. The self heating rate for RDX reaches values as high as 1000° C./min while the RDX/diethylenetriamine mixture maximum heating rate was only 2° C./min, indicating no explosive potential.

EXAMPLE 5

In order to assess environmental impact of the processes of the present invention, evolved gases were collected while mixing one part energetic materials with one part dielthylenetriamine at 80° C., and the gases were analyzed using infrared analysis. For TNT, ammonia was detected. For RDX, evolved gases were determined to be ammonia and dinitrogen oxide. Both of these byproducts of the method of the present invention are considered to be manageable from an environmental standpoint.

From the foregoing description, one skilled in the art can easily ascertain the essential characteristics of the invention defined in this specification and the appended claims, and without departing form the spirit and scope thereof can make various changes and modifications of the invention to adapt it to various usages and conditions. Such changes and modifications as would be obvious to one skilled in the art are intended to be included within the scope of the following claims. It is intended that the scope of the invention be defined by the claims appended hereto. The entire disclosures of all references, applications, patents and publications cited herein -are hereby incorporated by reference.

I claim:

1. A method for rendering energetic materials non-explosive, comprising the steps of:

mixing the energetic material with a reagent comprising an amine to form a reaction product, and combining the reaction product with epoxy resin.

2. The method of claim 1 wherein the energetic material comprises high explosive material.

3. The method of claim 2 wherein the reagent is selected from the group consisting of diethylenetriamine, tributylamine, monoethanolamine and propylene oxide-based triamine.

4. The method of claim 2 wherein the energetic materials are selected from the group consisting of RDX, TNT, Composition B, explosive D and any combinations thereof.

5. The method of claim 4 wherein the reagent is selected from the group consisting of diethylenetriamine, tributylamine, monoethanolamine and propylene oxide-based triamine.

6. The method of claim 1 wherein the reagent is selected from the group consisting of diethylenetriamine, tributylamine, monoethanolamine and propylene oxide-based triamine.

7. A method for rendering energetic materials non-explosive, comprising the steps of: mixing the energetic material with a reagent comprising an epoxy curing agent comprising amine to form a reaction product.

8. The method of claim 7 further comprising the step of combining the reaction product with epoxy resin.

9. The method of claim 8 wherein the energetic material comprises high explosive material.

10. The method of claim 9 wherein the energetic materials are selected from the group consisting of RDX, TNT, Composition B, explosive D and any combinations thereof.

11. A curing agent for epoxy resins prepared by a process comprising the step of:

reacting energetic material with a reagent comprising amine.

12. The curing agent of claim 11 wherein the reagent is selected from the group consisting of diethylenetriamine, tributylamine and monoethanolamine.

13. The curing agent of claim 11 wherein the reagent comprises triamine.

14. The curing agent of claim 13 wherein the triamine is propylene oxide-based triamine.

15. The curing agent of claim 11 wherein the reagent comprising amine is a compound that, when it is not combined with energetic material, acts as an epoxy curing agent.

* * * * *